US008628377B2

(12) United States Patent
Goldsmith et al.

(10) Patent No.: US 8,628,377 B2
(45) Date of Patent: Jan. 14, 2014

(54) FLEXURE ASSEMBLY

(75) Inventors: Richard Jonathan Goldsmith, San Luis Obispo, CA (US); Mark Allen Herendeen, Eden Prairie, MN (US); Robert Edward Chapin, Burnsville, MN (US)

(73) Assignee: Seagate Technology LLC, Scotts Valley, CA (US)

( * ) Notice: Subject to any disclaimer, the term of this patent is extended or adjusted under 35 U.S.C. 154(b) by 398 days.

(21) Appl. No.: 13/024,692

(22) Filed: Feb. 10, 2011

(65) Prior Publication Data

US 2012/0208440 A1 Aug. 16, 2012

(51) Int. Cl.
*B24B 1/00* (2006.01)

(52) U.S. Cl.
USPC ..... 451/11; 451/5; 451/278; 451/364; 451/387; 451/405; 269/903

(58) Field of Classification Search
USPC ..... 451/5, 8, 10, 278, 364, 387, 389, 390, 451/405; 269/55, 60, 903
See application file for complete search history.

(56) References Cited

U.S. PATENT DOCUMENTS 1,519,828 A * 12/1924 Fusay ..... 451/364
1,636,557 A * 7/1927 Guthrie ..... 451/276
4,776,136 A * 10/1988 Abendschein et al. ..... 451/364
4,792,005 A 12/1988 Olzog
5,435,774 A * 7/1995 Naujok ..... 451/364
5,447,467 A * 9/1995 Baltazar ..... 451/364
5,468,177 A * 11/1995 Kindler et al. ..... 451/364
5,738,568 A * 4/1998 Jurjevic et al. ..... 451/41
5,816,899 A * 10/1998 Hart et al. ..... 451/272
5,975,510 A 11/1999 Miyazaki
6,758,721 B2 * 7/2004 Shindo et al. ..... 451/5
6,813,225 B2 * 11/2004 Widdowson et al. ..... 369/44.15
7,153,198 B2 * 12/2006 Fujii et al. ..... 451/41
7,288,861 B1 10/2007 Willard et al.
7,393,262 B2 * 7/2008 Biskeborn ..... 451/8
7,407,431 B2 * 8/2008 Lee et al. ..... 451/5
7,550,880 B1 6/2009 Pusl
7,871,306 B1 1/2011 Lytle

* cited by examiner

*Primary Examiner* — George Nguyen
(74) *Attorney, Agent, or Firm* — Kagan Binder, PLLC

(57) ABSTRACT

A flexure assembly comprising a flexure stack comprising a plurality of individual webs connected together with a force in an x-direction to produce a friction in a z-direction orthogonal to the x-direction between the plurality of webs, the friction holding the plurality of webs in engagement. In some embodiments, the flexure assembly includes a second flexure stack fixedly spaced from the first stack comprising a second plurality of individual webs connected together with a second force in the x-direction to produce a second friction in the z-direction between the second plurality of webs. The flexure assembly may be used, for example, for supporting a workpiece such as a slider row bar in a lapping machine.

20 Claims, 5 Drawing Sheets

FLEXURE ASSEMBLY

BACKGROUND OF THE INVENTION

Lapping machines are common for producing read-write heads, or sliders, for disc drives. An example of a commercially available row bar lapping machine is the "Optium ASL 200 Lapping System" from Veeco Instruments. A row bar lapping machine, sometimes alternately referred to as a row or bar lapping machine, requires very accurate and precise control of the pitch angle of the bar during the polishing process. The bar must be allowed to move downward as material is lapped from the bar without affecting the pitch angle, and if the bar is lifted up off the platen, it must be done without disturbing the pitch angle.

Precise linear bearings allow for the necessary vertical motion for the lapping head and thereon mounted bar, but they do not meet the stiffness requirements. Conventional parallelogram flexure assemblies, which allow precise translation without rotation, may be acceptable for pitch control, but are usually large in size and expensive.

Conventional parallelogram flexures include a "web" formed from a single piece of metal, usually formed by electrical discharge machining (EDM). The EDM process generally limits the horizontal webs to no less than 0.015 inch thick. Because the actuation force to move the flexure vertically is proportional to the cube of the horizontal web thickness, in order to keep the actuation force manageable, it is desired to have the horizontal webs as thin as possible. Unfortunately, it is difficult with EDM to make the webs sufficiently thin. Even if EDM-made webs were sufficiently thin, the cost of the EDM process may be cost prohibitive.

Improved flexure designs are desired.

SUMMARY

One particular embodiment of this disclosure is a flexure assembly having a first flexure stack composed of a first plurality of individual webs connected together with a first compressive force, and a second flexure stack fixedly spaced from the first stack, the second flexure stack composed of a second plurality of individual webs connected together with a second compressive force. The first force produces a first friction between the first plurality of individual webs and the second force produces a second friction between the second plurality of individual webs. The first force and the second force hold their respective plurality of webs in engagement.

These and various other features and advantages will be apparent from a reading of the following detailed description.

BRIEF DESCRIPTION OF THE DRAWING

The invention may be more completely understood in consideration of the following detailed description of various embodiments of the invention in connection with the accompanying drawing, in which.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF THE INVENTION

The present disclosure provides a flexure assembly, such as for use with a bar row lapping machine, that incorporates a plurality of springs stacked and fixedly attached together to create a horizontal web. The plurality of stacked springs provides an assembly that allows linear movement in one direction yet inhibits pitch, roll and yaw movement.

In the following description, reference is made to the accompanying drawing that forms a part hereof and in which is shown by way of illustration at least one specific embodiment. The following description provides additional specific embodiments. It is to be understood that other embodiments are contemplated and may be made without departing from the scope or spirit of the present invention. The following detailed description, therefore, is not to be taken in a limiting sense. While the present invention is not so limited, an appreciation of various aspects of the invention will be gained through a discussion of the example provided below.

Figure 1:
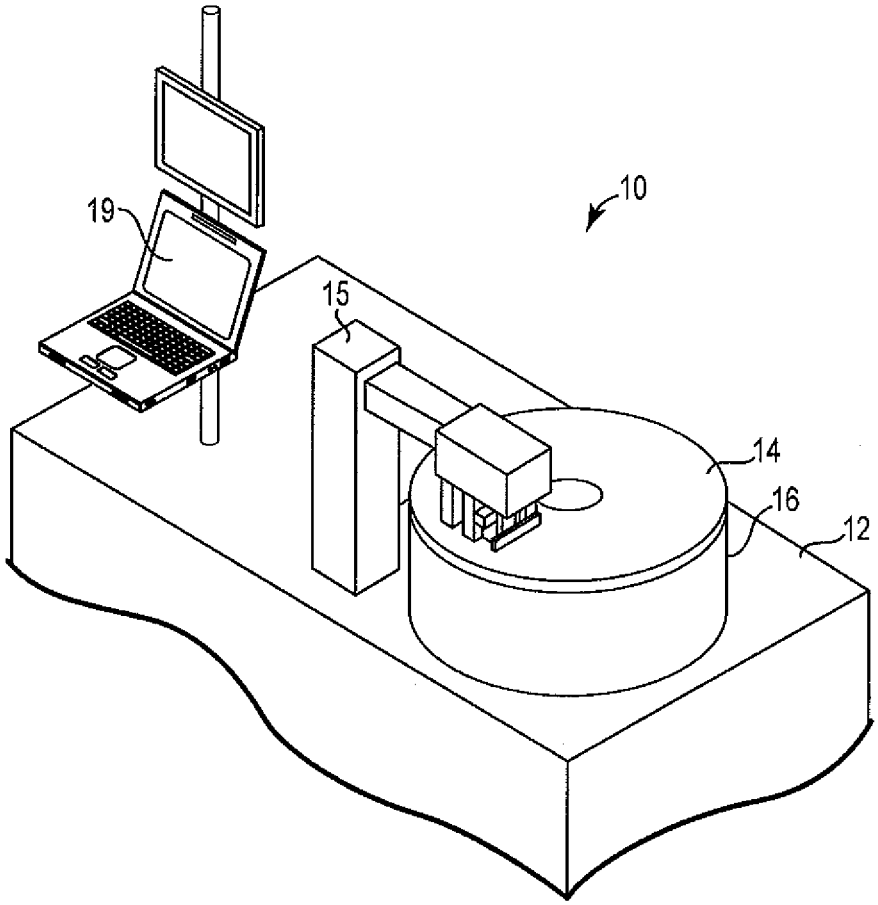
FIG. 1 is a perspective view of a general row bar lapping machine.

FIG. 1 illustrates a schematic view of a general row bar lapping machine 10. In a manufacturing process for a magnetic head slider or read-write head, a magnetic head thin film is formed on a substrate and subjected to a lapping process, thereby making constant the heights of a magnetoresistive layer and a gap in the magnetic head thin film. In order for the eventual slider or head to operate properly, the heights of the magnetoresistive layer and the gap must be constant, with accuracy on the order of submicrons. During the lapping process, the slider must not pitch, roll, or yaw, as any rounded edges or surfaces are unacceptable. The lapping machine for lapping the row bar must have a high accuracy.

Lapping machine 10 includes a base 12 that houses various mechanical systems and supports the lapping mechanics 14, which includes an arm 15 and a platen 16. Machine 10 includes a control system 19 to activate, adjust and operate lapping mechanics 14. Examples of systems that may be a part of lapping mechanics 14 include pressure adjustment mechanism(s) which press arm 15 toward platen 16 and pressure sensor(s), position adjustment sensor(s) and mechanisms, and other systems that do not form a part of the invention herein, but that are known to those knowledgeable in lapping machine design, construction and use. Not illustrated in FIG. 1, a row tool attaches a slider row bar to the bottom side of arm 15. Lapping machine 10 is configured to lap (e.g., polish) the slider row bar on rotating platen 16 using either an abrasive slurry or an abrasive article. During lapping, the slider row bar moves downward as material is lapped from the bar. In some lapping machine designs, the row bar reciprocally moves in the radial direction of platen 16.

Figure 2A:
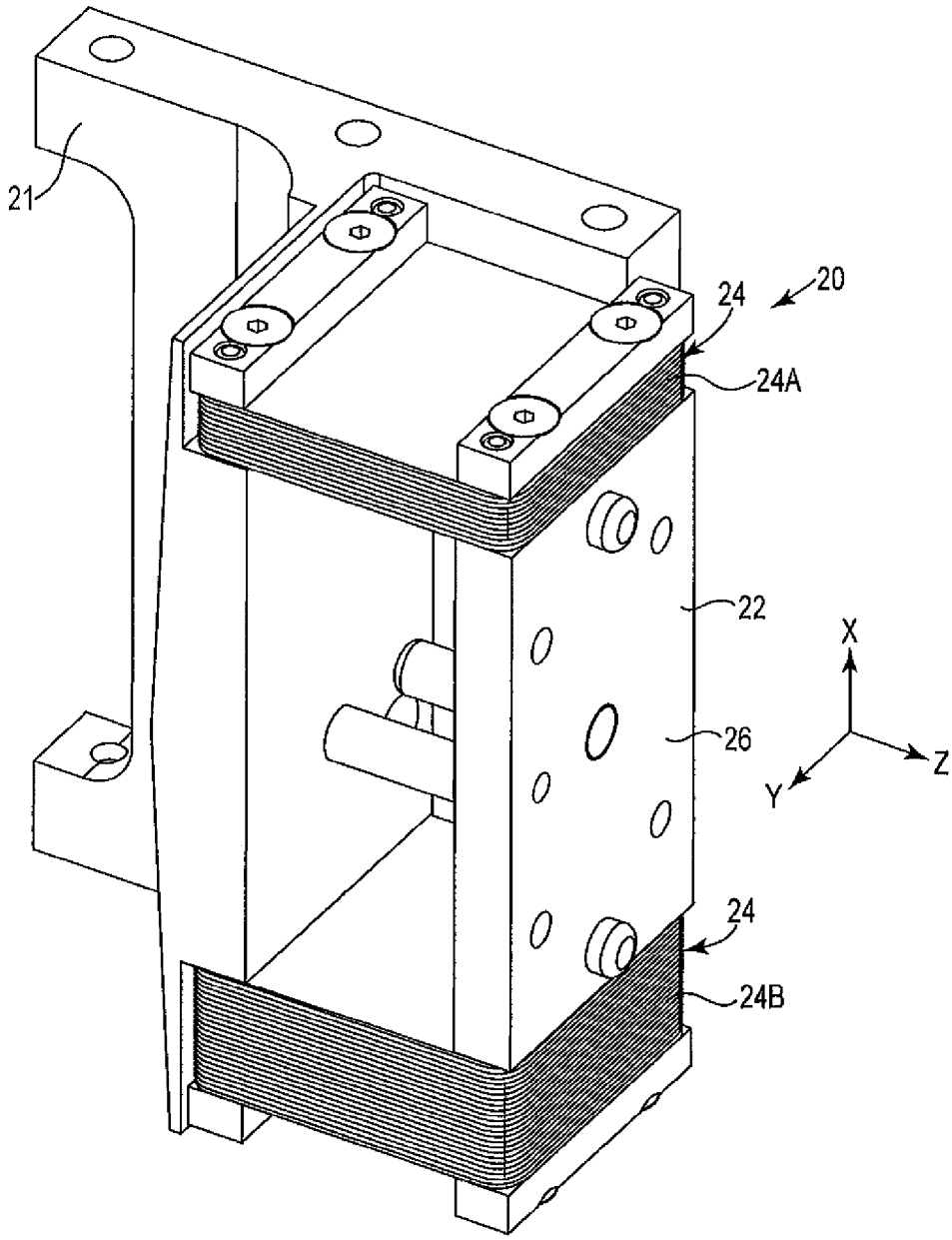
FIG. 2A is a perspective view of a flexure assembly according to the present disclosure.
Figure 2B:
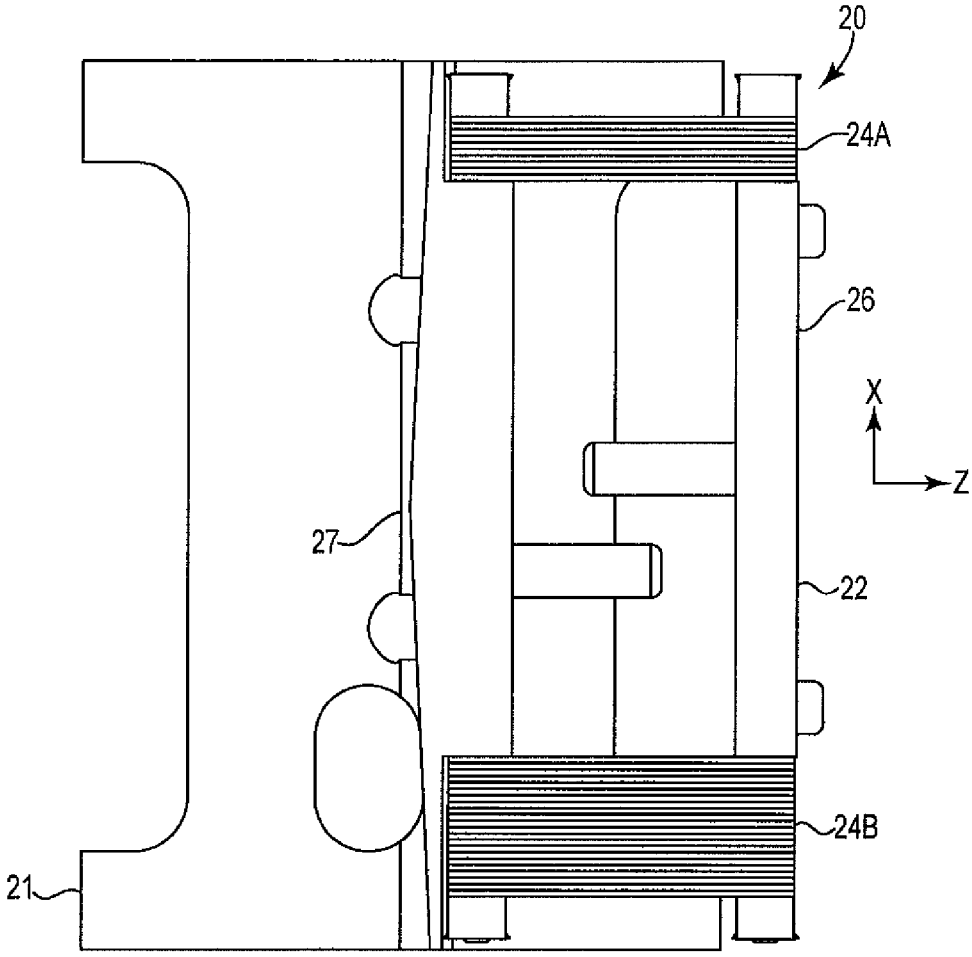
FIG. 2B is a front view of the flexure assembly.

FIGS. 2A and 2B illustrate a flexure assembly 20 that can be attached to arm 15 of lapping machine 10. Flexure assembly 20 is used to support a slider row bar (not illustrated) during a lapping process.

Flexure assembly 20 has a first side 21 and an opposite second side 22. In the illustrated embodiment, first side 21 is a "moveable", "moving", or "adjustable" side and second side 22 is a "fixed" or "rigid" side. With these designations, what is intended is that first side 21 is free to move vertically in relation to arm 15 (FIG. 1) and second side 22 is fixed to arm 15 so that second side 22 has no vertical motion or travel in relation to arm 15. In other embodiments, first side 21 may be a "fixed" or "rigid" side and second side 22 is a "moveable", "moving", or "adjustable" side. Flexure assembly 20 is mounted or fixed to its supporting structure (e.g., arm 15) via its fixed or rigid side. Flexure assembly 20 can generally be referred to as a parallelogram flexure assembly.

Figure 7:
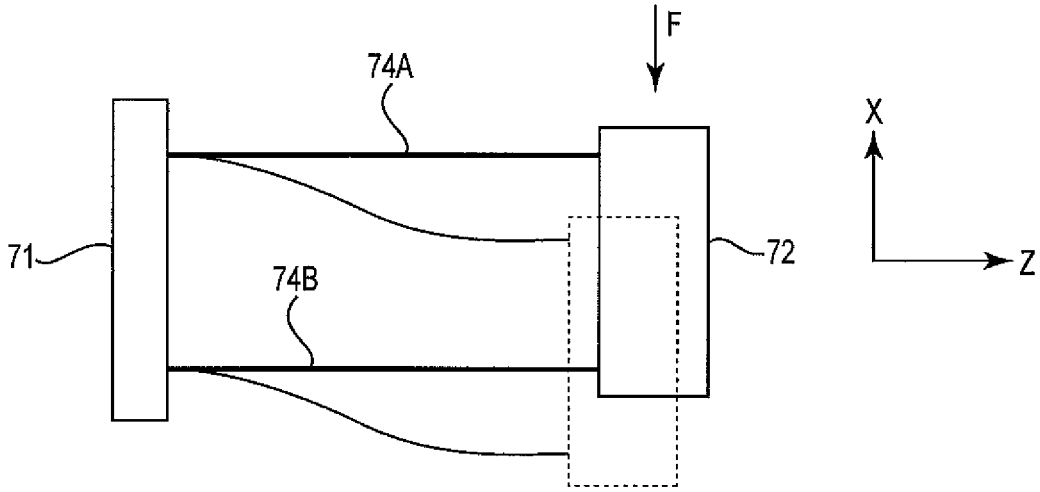
FIG. 7 is a schematic side view of a generic parallelogram flexure.

A generic parallelogram flexure assembly and its movement are illustrated in FIG. 7. In this figure, the parallelogram flexure assembly includes a top flexure 74A and a bottom flexure 74B. Flexures 74A, 74B are fixedly connected together at a first, rigid side 71 and at a second, moveable side 72. FIG. 7 illustrates the flexure unit in both its undeformed (natural) state and deformed state upon application of force F. Parallelogram flexure assemblies such as that illustrated in FIG. 7 offer some resistance to relative motion in the x-direction and are very stiff with respect to relative motion in the z-direction and to rotation.

The flexure assemblies of the present invention (e.g., flexure assembly 20 of FIGS. 2A and 2B), however, allow vertical movement at the moveable side yet inhibit rotational movement around a vertical axis (i.e., the x-axis) of assembly 20 and additionally inhibit rotational movement around the y-axis and z-axis of assembly 20. Flexure assembly 20 allows no more than 1 microradian rotation, in some embodiments no more than 0.5 microradian rotation, and in other embodiments no more than 0.25 microradian rotation in each of the directions. Designs with less than 0.1 microradian rotation are also possible. In some embodiments, flexure assembly 20 also inhibits pivotal movement or pitch. Stated another way, flexure assembly 20 allows movement of the slider row bar (or other equipment or piece being supported by flexure assembly 20) in the x-direction, yet inhibits movement in the y-direction and in some embodiments also in the z-direction. Flexure assembly 20 is fairly stiff and robust, light weight, and provides precision movement in the direction of the vertical axis.

In accordance with this invention, flexure assembly 20 uses multiple thin sheets or webs that are stacked and connected (e.g., bolted) together to create a horizontal web stack 24. A stack 24 having a plurality of thin sheets is preferred over a single web of similar thickness; although a single web would inhibit pitch, it would take too much force to achieve the desired vertical movement allowed by flexure assembly 20. Flexure assembly 20 of this embodiment includes two vertically arranged web stacks 24, a top stack 24A and a bottom stack 24B; other flexure assemblies may utilize only a single web stack 24. Connecting top stack 24A in fixed vertical relation to bottom stack 24B are end supports 26, 27. In their unstressed or natural state, stacks 24A, 24B extend horizontally. End supports 26, 27, which preferably are vertical and at a right angle to each of stacks 24A, 24B, are configured to inhibit and preferably not allow any vertical, pivotal or rotational movement between top stack 24A and bottom stack 24B.

Various factors dictate the number of webs that constitute top and bottom web stacks 24A, 24B. For example, the desired distance of allowable vertical travel is a factor, as is the lifting force available for initiating the travel. The material and thickness of the webs in the stacks also affects the number of webs, as does the overall size of flexure assembly 20. As a non-limiting example, stack 24A in FIGS. 2A and 2B has six (6) webs and stack 24B has twelve (12) webs.

Figure 3:
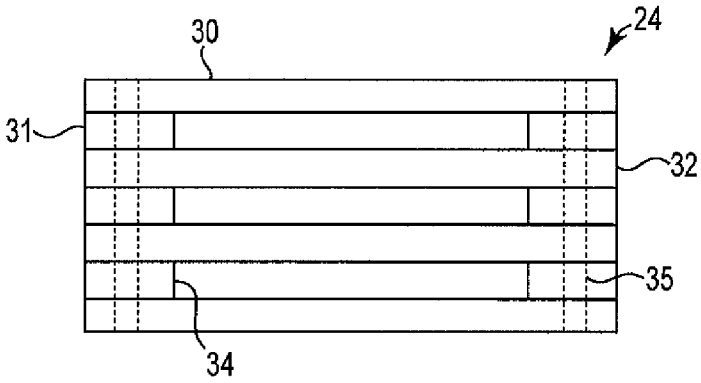
FIG. 3 is a side view of a flexure web stack used in the flexure assembly of FIGS. 2A and 2B.

Turning to FIG. 3, a portion of a flexure web stack 24 is illustrated. Stack 24 is composed of a plurality of parallel webs 30, each having a first edge 31 and a second edge 32. Even though stack 24 of FIG. 3 is illustrated with four (4) webs 30, it should be understood that this figure is merely for illustration of stack 24 and webs 30 and their connection, and is not limiting, just as the six (6) and twelve (12) webs in stacks 24A, 24B, respectively, in FIGS. 2A and 2B is not limiting. Each web 30 is individual and discrete from each other web 30; that is, each web 30 is separate from each other web 30 and there is no permanent connection between webs 30 so they can be assembled (e.g., stacked) and disassembled at any time. Webs 30 are stacked in the x-direction, which in the illustrated embodiment of FIGS. 2A and 2B, is vertical. In this embodiment, first edge 31 is proximate free side 21 of flexure assembly, and second edge 32 is proximate fixed side 22 of flexure assembly 20.

Various features of stack 24 can be modified to obtain the desired vertical movement, pitch and rotation. Features of stack 24 that can be varied include the number of webs 30, the material of webs 30, the thickness of webs 30, the length, width and overall shape of webs 30, the spacing between webs 30, the size of any spacers between adjacent webs 30, the mode of attaching webs 30 together, and the distance between multiple stacks, if present.

In preferred embodiments, each web 30 is made from a metallic material, such as steel, stainless steel (e.g., SS 304, SS 314, etc.), nickel, aluminum, copper, titanium, or alloys thereof. Webs 30 may alternately be non-metallic, such as made from ceramic or carbon-based composite material. Stainless steel is a preferred material for webs 30 as it is readily inexpensive, is available in a variety of thicknesses and sizes and is corrosion resistant. Generally, each web 30 in stack 24 will be of the same material, although this is not required.

The thickness of each web 30 is usually no greater than about 0.05 inch (1.27 mm), in order to provide no more than the desired amount of vertical movement to free side 21 of flexure assembly 20. Typically, webs 30 will be about 0.0005 inch (0.0127 mm) to about 0.01 inch (0.254 mm) thick. In general, thinner webs 30 are desired, as less force is required to lift the desired side 21 of resulting stack 24. Stainless steel webs 30, with thicknesses about 0.001 inch (0.0254 mm) to about 0.005 inch (0.127 mm), are particularly suited for lapping machine applications due to the resistance to the chemicals used during a lapping process. Stainless steel shims in thicknesses of 0.001 inch (0.0254 mm), 0.002 inch (0.0508 mm), and 0.004 inch (0.1016 mm) are readily available and provide designs with a manageable number of webs 30 that have adequate movement and do not require an exorbitant force to lift stack 24. Stainless steel at 0.002 inch (0.0508 mm) thick provides a manageable number of webs 30, is easy to work with (e.g., physically assembly stack 24), and results in stack 24 have a fairly low lifting force. Generally, each web 30 in stack 24 will have the same thickness, although this is not required.

Of course, the thickness of webs 30 will affect the total number of webs 30 in stack 24. In general, since rotation of the moving piece is restrained by membrane stresses in the webs 30, as the webs 30 decrease in thickness, their number in stack 24 must proportionately increase. As an example, a stack with twenty-five (25) webs 0.002 inch (0.0508 mm) thick is essentially equivalent to a stack with fifty (50) webs of the same material 0.001 inch (0.0254 mm) thick for inhibiting rotation, or to a stack with twelve to thirteen (12-13) webs 0.004 inch (0.1016 mm) thick. However, as the thickness of webs 30 increases and their number decreases, more lifting force is needed for the desired distance of vertical travel. Also, as the thickness of webs 30 decreases, the difficulty in assembling stack 24 increases. Thus, a suitable balance between the number of webs 30 and their thickness should be found. In general, stack 24 will have at least five (5) webs 30 or ten (10) webs 30, in some embodiments at least twenty (20) webs 30, although the number of webs 30 will depend on the material, its thickness, the desired vertical movement allowed, the maximum lifting force available, and the maximum rotational and pivotal movement allowed. In some embodiments space constraints may also factor on the design of stack 24. Examples of the number of webs 30 in a stack 24 include, fifty (50) webs, sixty-five (65) webs, one hundred (100) webs, one hundred fifty (150) webs, one hundred sixty-five (165) webs, one hundred seventy-five (175) webs, and two hundred (200) webs. These examples are in no way limiting to the number of webs 30 that could be in a stack 24.

In general, webs 30 will be sized and shaped to conform to the area or volume allowed for flexure assembly 30. In some embodiments, webs 30 may be rectangular (in plan form), with a size of from about 1 inch (2.54 cm) to about 6 inches (15.24 cm) per side. Of course, smaller and larger web sizes can be used. The shape of webs 30 may be selected to conform to the area allowed, or may be selected for certain properties. Webs 30 can be any suitable shape. As an example, some webs 30 may be rectangular, square, oval or oblong, hourglass shaped or double hourglass shaped.

Referring back to FIGS. 2A and 2B, the total number of stacked webs 30 in flexure assembly 20 can be reduced or even minimized by recognizing that the required horizontal force in top stack 24A is less than the force required in bottom stack 24B. The number of stacked webs 30 and thus the thickness of stack 24A, 24B is proportionate to the horizontal force each is supporting. In some embodiments, the number of webs 30 in top stack 24A is the same as in bottom stack 24B; however, this would be an inefficient design, as the top webs would be over designed and not be as stressed as the bottom webs. In other embodiments, stacks 24A, 24B are designed with a different number of webs 30 in stack 24A than in stack 24B; depending on the number of webs 30 in stacks 24A, 24B, this may bring all webs 30 to the same stress, make the optimum use of material, and minimize the total number of webs 30. As indicated above, the embodiment of FIGS. 2A and 2B has six (6) webs in stack 24A and twelve (12) webs in stack 24B.

Returning to FIG. 3, adjacent webs 30 can be spaced apart by a spacer 34 that is positioned at each edge 31, 32. Spacers 34 may be any suitable material, for example, metal (e.g., steel, stainless steel, nickel, aluminum, etc. and alloys thereof), polymeric material (e.g., polypropylene, polycarbonate, ABS), and ceramic material. Spacers 34 allow freedom of movement while inhibiting rubbing, binding, and friction between adjacent webs 30. In most embodiments, spacers 34 are present only proximate edges 31, 32, but in some embodiments, spacers 34 may extend between the entire distance between edge 31 and edge 32. Any decrease in flexibility of stack 24 and thus flexure assembly 20 due to the presence of spacers 34 and how they affect the vertical flexibility of stack 24 should be accounted for in the design of flexure assembly 20.

Webs 30 and optional spacers 34 are connected together to form stack 24 composed of the plurality of individual webs 30. Edges 31, 32 of webs 30 are fixed in relation to adjacent webs 30; that is, edges 31 of all webs 30 are fixed in relation to each other and edges 32 of all webs 30 are fixed in relation to each other. Between each web 30 and adjacent web 30 or spacer 34 is a certain amount of friction holding flexure stack 24 together.

FIG. 3 illustrates a bore 35 extending through webs 30 and through spacers 34 for receiving a bolt therethrough and securing webs 30 and spacers 34 together; not seen is a second bore at each edge 31, 32 for receiving a second bolt therethrough. Generally, bore 35 is not so tight as to provide an interference fit with the bolts, as it would be very difficult to assembly. Rather, bores 35 and the bolts are loose, allowing an amount of play in the plane of webs 30. Predominantly, bolts and bores 35 are used for aligning the plurality of webs 30 and spacers 34, generally not for producing the needed friction between webs 30 and spacers 34. Other mechanical mechanisms, such as a bar that extends a length along edge 31, 32, may be used to secure webs 30 and spacers 34 together to obtain the needed friction. Alternately or additionally, adhesive may be used to connect webs 30 and spacers 34 at edges 31, 32.

As indicated above, between each web 30 and adjacent web 30 or spacer 34 is a certain amount of friction, which holds flexure stack 24 together and provides the desired flex resistance. When under pressure, each web 30 has the same compressive or tensile force on it, trying to slide it out of the stack laterally (i.e., in the plane of the web). This slippage is resisted by the friction forces present between web 30 and the adjacent web 30 or spacer 34. Typically, the friction against the bottom of each web 30 is greater than the friction on the top surface of the web; the friction difference between the bottom of each web 30 and the top of each web 30 is the web tensile force. The friction force builds as one progresses down through stack 24, with the greatest friction at the bottom web 30 where it is held by end supports 26, 27. The friction force at end supports 26, 27 is the sum of all the individual web tensions.

As an example, if there were only three (3) webs 30 in stack 24 and each web 30 had a friction force tension of X, the total force on stack 24 would be 3X. Assuming X is 1 lb, the total stack force would be 3 lbs, which would be equal to the final friction at end supports 26, 27. This sets a limit on the maximum stack force; the stack force cannot be greater than the clamping force multiplied by the coefficient of friction. As an example, if the coefficient of friction was 0.5 and the bolt clamped with 10 lbs, then the maximum stack force would be 5 lbs. Because stack 24 is at 3 lbs, in this example, stack 24 holds together when a lifting force is applied.

However, holding webs 30 with friction has both advantages and disadvantages. On the plus side, it allows easy assembly, looser hole location and tolerance, and easier final adjustment (for example, the bolts can be loosened and the angle with end supports 26, 27 can be readily adjusted). On the down side, the maximum tension each web 30 can carry is dependent on how much clamping force is applied. That is, a greater clamping force provides greater individual web tension.

In one specific embodiment of flexure assembly 20, top stack 24A is composed of seventy-six (76) webs 30 and bottom stack 24B is composed of one hundred sixty-five (165) webs 30 with spacers 34 between adjacent webs 30 in each top stack 24A and bottom stack 24B. Each of these webs 30 is formed of 0.002 inch (0.0508 mm) thick, 1.649 inches (4.188 cm) wide and 1.522 inches (3.866 cm) long stainless steel material and each spacer 34 is 0.002 inch (0.0508 mm) thick stainless steel. Spacers 34 do not extend the length of webs 30 (i.e., from edge 31 to edge 32), but are present only at edges 31, 32. The two stacks 24A, 24B are spaced 2.604 inches (6.614 cm) apart via end supports 26, 27. Webs 30 and spacers 34 of each stack 24A, 24B are bolted together with two bolts proximate each side edge 31, 32. This flexure assembly 20 allows vertical movement of up to 0.050 inch (1.27 mm), allows rotation of no more than 0.25 microradian, and requires a lifting force of no more than 7 pounds force.

It is understood that numerous variations of the flexure assembly could be made while maintaining the overall inventive design of individual stacked webs and remaining within the scope of the invention. Numerous alternate design or element features have been mentioned above.

Figure 4:
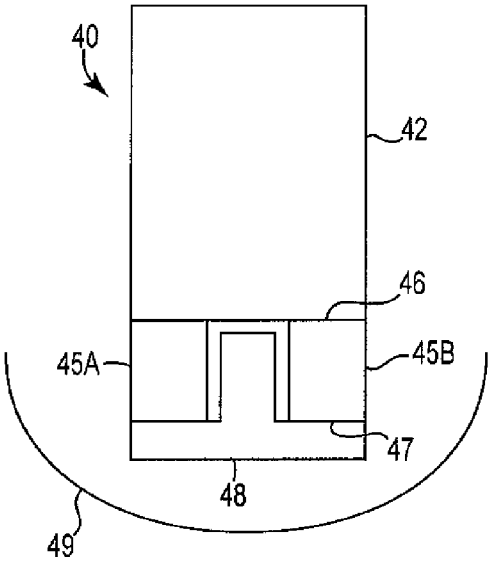
FIG. 4 is a schematic top view of an embodiment of a row bar lapping machine, particularly an arm, flexure assemblies, and lap head.

Referring now to FIG. 4, a first embodiment of a flexure assembly according to this invention is illustrated as used in a lapping machine. Lapping assembly 40 includes an arm 42 onto which is mounted a first flexure assembly 45A and a second flexure assembly 45B. Flexure assemblies 45A, 45B are attached to arm 42 via fixed or rigid side 46. Moveable side 47 is connected to a lap head 48, onto which is mounted a slider row bar (not seen in FIG. 4). With this arrangement, fixed or rigid side 46 is physically attached to, and thus closer to, arm 42 than moveable side 47. Flexure assemblies 45A, 45B allow vertical movement of lap head 48 towards platen 49.

Figure 6:
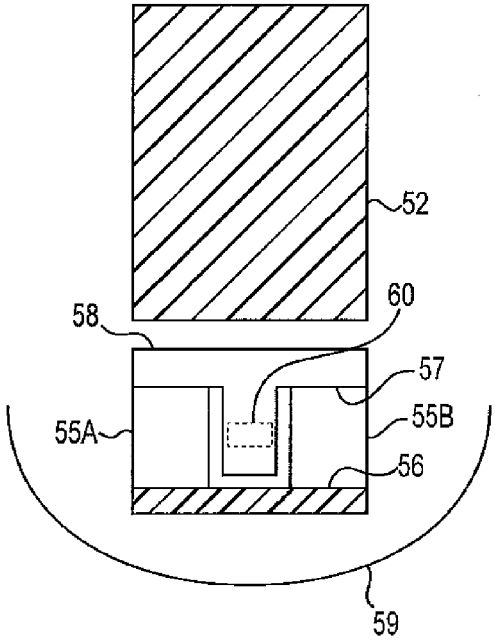
FIG. 6 is a cross-sectional top view of the row bar lapping machine of FIG. 5 taken along line 6-6.
Figure 5:
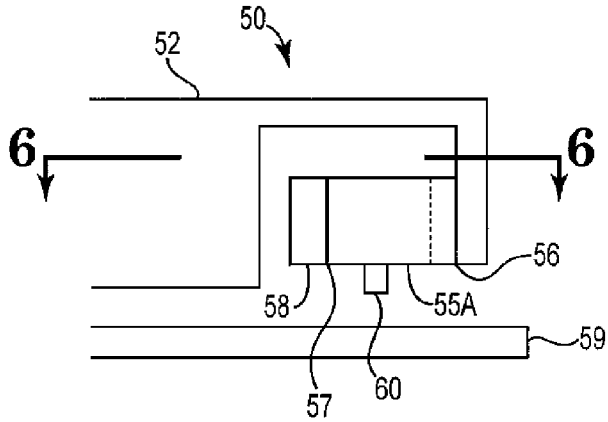
FIG. 5 is a side view of an embodiment of a row bar lapping machine, particularly an arm, flexure assemblies, and lap head.

An alternate embodiment of a lapping machine with a flexure assembly according to this invention is illustrated in FIGS. 5 and 6. Lapping assembly 50 includes an arm 52 onto which is mounted a first flexure assembly 55A and a second flexure assembly 55B. In this embodiment, a portion of arm 52 extends over flexure assemblies 55A, 55B so that flexure assemblies 55A, 55B are supported below arm 52. Flexure assemblies 55A, 55B are attached to arm 52 via fixed or rigid side 56. Moveable side 57 is connected to a lap head 58, onto which is mounted a slider row bar 60. Flexure assemblies 55A, 55B allow vertical movement of lap head 58 towards platen 59.

Although the discussion above has focused on using flexure assembly 20 and other embodiments in lapping machines, a flexure assembly composed of one or two connected stacks of individual webs could be used in other applications where flexure assemblies are used. Examples of such applications include the aerospace industry, such as on rocket launch vehicles, and vibration control for vehicles such as helicopters. Another example of a suitable use for flexure assemblies of this invention is in semi-conductor or optical processing applications, where the workpiece must be accurately held. Disk drives utilize a flexure to maintain the position of the read-write head or slider in relation to the data disk. Flexure assemblies according to this invention can be used in any application that requires one directional movement while inhibiting rotational and pivotal (i.e., pitch, roll and yaw), such as any machining or processing application that requires holding a tool or workpiece in a stable and accurate manner.

Thus, embodiments of the FLEXURE ASSEMBLY are disclosed. The implementations described above and other implementations are within the scope of the following claims. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A flexure assembly for a lapping machine, the flexure assembly comprising:

a first flexure stack comprising a first plurality of individual webs connected together with a first force in an x-direction to produce a first friction in a z-direction orthogonal to the x-direction between the first plurality of webs, the first stack having a first side and a second side, a second flexure stack fixedly spaced from the first stack comprising a second plurality of individual webs connected together with a second force in the x-direction to produce a second friction in the z-direction between the second plurality of webs, the second stack having a first side and a second side, a first end support connecting the first side of the first stack to the first side of the second stack the first end support connected to an arm of the lapping machine, and a second end support connecting the second side of the first stack to the second side of the second stack the second end connected to a lapping head, with, the first friction and the second friction holding their respective plurality of webs in engagement.

2. The flexure assembly of claim 1 wherein each of the first flexure stack and the second flexure stack comprises at least 50 individual webs connected together in the x-direction.

3. The flexure assembly of claim 1 wherein each of the first plurality of individual webs and the second plurality of individual webs is clamped to provide the first friction and the second friction, respectively.

4. The flexure assembly of claim 1 wherein the first flexure stack has a different number of individual webs than the second flexure stack.

5. The flexure assembly of claim 1 wherein each of the individual webs comprises metal.

6. The flexure assembly of claim 5 wherein the metal is stainless steel.

7. The flexure assembly of claim 1 wherein each of the individual webs is 0.001 inch to 0.01 inch thick.

8. The flexure assembly of claim 1 further comprising a first plurality of spacers positioned between the individual webs of the first flexure stack, and a second plurality of spacers positioned between the individual webs of the second flexure stack.

9. A flexure assembly for a lapping machine, the flexure assembly comprising:

a first flexure stack comprising a first plurality of individual webs stacked in an x-direction and connected together; and a second flexure stack comprising a second plurality of individual webs stacked in the x-direction and connected together, the second flexure stacked fixedly spaced from the first flexure stack in the x-direction;

both the first flexure stack and the second flexure stack fixed to an arm of the lapping machine and to a lapping head;

the flexure assembly allowing movement of the lapping head in relation to the arm along an x-axis and limiting rotational movement around each of the x-axis, a y-axis and a z-axis to less than 1 microradian, and inhibiting movement in a y-direction.

10. The flexure assembly of claim 9 limiting rotational movement around each of the x-axis, the y-axis and the z-axis to less than 0.5 microradian.

11. The flexure assembly of claim 9 wherein each of the first flexure stack and the second flexure stack comprises at least 50 individual webs connected together.

12. The flexure assembly of claim 9 wherein the first flexure stack has a different number of individual webs than the second flexure stack.

13. The flexure assembly of claim 9 wherein each of the individual webs comprises metal.

14. The flexure assembly of claim 13 wherein the metal is stainless steel.

15. The flexure assembly of claim 9 wherein each of the individual webs is no more than 0.005 inch thick.

16. The flexure assembly of claim 9 further comprising a first plurality of spacers positioned between the individual webs of the first flexure stack, and a second plurality of spacers positioned between the individual webs of the second flexure stack.

17. A lapping machine having an arm and a flexure assembly for supporting a workpiece, the flexure assembly comprising a flexure stack comprising a plurality of individual webs connected together, the flexure stack having a first side fixed to the arm and second side movable in relation to the arm, the workpiece operably connected to the moveable side.

18. The lapping machine of claim 17 further comprising a second flexure assembly comprising a second flexure stack the same as the flexure assembly, the second flexure assembly comprising a second flexure stack comprising a second plurality of individual webs connected together, the second flexure stack having a first side fixed to the arm and second side movable in relation to the arm, the workpiece also operably connected to the moveable side of the second flexure stack.

19. The lapping machine of claim 17 wherein the fixed side is physically closer to the arm than the moveable side.

20. The lapping machine of claim 17 wherein a portion of the arm extends over the flexure assembly and the workpiece.

* * * * *

UNITED STATES PATENT AND TRADEMARK OFFICE

CERTIFICATE OF CORRECTION

PATENT NO. : 8,628,377 B2
APPLICATION NO. : 13/024692
DATED : January 14, 2014
INVENTOR(S) : Richard Jonathan Goldsmith, Mark Allen Harendeen and Robert Edward Chapin It is certified that error appears in the above-identified patent and that said Letters Patent is hereby corrected as shown below:

In the Claims

At column 8, lines 11-12: "the second end connected" should be -- the second end support connected --

Signed and Sealed this
Sixth Day of May, 2014

Michelle K. Lee

Michelle K. Lee
*Deputy Director of the United States Patent and Trademark Office*